US011628681B2

(12) United States Patent
Fernandez Munizaga

(10) Patent No.: US 11,628,681 B2
(45) Date of Patent: Apr. 18, 2023

(54) PRE-ASSEMBLED CANVAS FOR PAINTING OR PRINTING

(71) Applicant: INVERSIONES PUNTA CIELO LIMITADA, Santiago (CL)

(72) Inventor: Rodrigo Fernandez Munizaga, Santiago (CL)

(73) Assignee: INVERSIONES PUNTA CIELO LIMITADA, Santiago (CL)

( * ) Notice: Subject to any disclaimer, the term of this patent is extended or adjusted under 35 U.S.C. 154(b) by 1135 days.

(21) Appl. No.: 16/244,464

(22) Filed: Jan. 10, 2019

(65) Prior Publication Data

US 2019/0210403 A1 Jul. 11, 2019

(51) Int. Cl.

| | |
|---|---|
| ***A47G 1/06*** | (2006.01) |
| ***B44D 3/18*** | (2006.01) |
| *A47G 1/10* | (2006.01) |

(52) U.S. Cl.

CPC ..... *B44D 3/18* (2013.01); *A47G 1/0633* (2013.01); *B44D 3/185* (2013.01); *A47G 1/10* (2013.01); *A47G 2001/0661* (2013.01)

(58) Field of Classification Search

CPC ..... B44D 3/18; B44D 3/185; A47G 1/0633; A47G 1/10; A47G 2001/0661

See application file for complete search history.

(56) References Cited

U.S. PATENT DOCUMENTS

| | | | | |
|---|---|---|---|---|
| 9,861,215 | B2 * | 1/2018 | Ridless | B44C 5/02 |
| 10,765,238 | B2 * | 9/2020 | Millman | A47G 1/16 |
| 2011/0016759 | A1 * | 1/2011 | Ramos-Gonzalez | B31F 1/2818 156/60 |
| 2013/0205631 | A1 * | 8/2013 | Steichen | A47G 1/0633 40/743 |
| 2018/0213950 | A1 * | 8/2018 | Millman | A47G 1/17 |
| 2019/0248173 | A1 * | 8/2019 | Ridless | B44D 3/185 |
| 2019/0261789 | A1 * | 8/2019 | Millman | A47G 1/0633 |

FOREIGN PATENT DOCUMENTS

| | | | | |
|---|---|---|---|---|
| EP | 3753457 | A1 * | 12/2020 | A47G 1/0633 |
| WO | WO-2015058504 | A1 * | 4/2015 | A47G 1/0633 |

* cited by examiner

*Primary Examiner* — Cassandra Davis

(74) *Attorney, Agent, or Firm* — Hoffman Warnick LLC

(57) ABSTRACT

The invention provides a canvas for painting or printing. More specifically, it is a pre-assembled structure which allows flat storage and transportation. It is easy to assemble and has supports with different thicknesses. It has a support for painting or printing and an integrated frame.

9 Claims, 7 Drawing Sheets

PRE-ASSEMBLED CANVAS FOR PAINTING OR PRINTING

CROSS-REFERENCE TO RELATED APPLICATIONS

This application claims the benefit of co-pending Chilean Patent Application Serial No. CL 0086-2018, filed 11 Jan. 2018, which is hereby incorporated herein as though fully set forth.

DESCRIPTION OF THE PRIOR ART

In the field of materials available for painting or printing works or expose graphic components, it is usual to find canvases mainly made up of a rigid stretcher frame and a tightened fabric attached to the perimeter of the stretcher frame.

Fabrics are usually made up of natural/flexible materials. The stretcher frames are usually made up of a perimeter frame made of solid wood and the fabric is mainly fastened with staples.

This is a proper solution for canvases of a medium or small format. The stretcher frame has square pieces of up to 40 mm, but it is not good for bigger formats, as the stretcher frame must be more robust. Sizes bigger than the aforementioned become expensive and huge, thus transportation of assembled bigger pieces is difficult and there is need of more room for of storage at specialized stores.

Some special solutions for bigger canvases have been devised, which require a special type of installation in order to properly tighten the fabric on big size stretcher frames. The fabric is glued onto a piece of cardboard or a thin wooden panel, which has to be fastened to the stretcher frame anyway, thus increasing costs and still not solving the storage/transportation problem. Another problem arising from big size canvases is that manufacturing process is much slower and complex, as bigger size frames require more hours and hard work to tighten and staple the fabric to the stretcher frame.

That is why this invention solves Prior Art problems by providing a pre-assembled structure which allows manufacturing big size canvases which may be flat stored and transported.

Another objective of this model is to make canvas manufacturing easier, as this allows a more automated process.

Another objective is to provide assorted canvas sizes, not only regarding painting or printing surface, but also regarding frame thicknesses. In case of big fabrics a bigger thickness is necessary to get more rigidity without providing big pieces of solid wood to make up a big frame.

Another objective of this model is to make canvas assembly easier with no further need of equipment or special skills; therefore any person or even the user may assemble it.

Another further objective is to provide full support for the fabric where the painter leans on and where the work is painted, so that the fabric does not tear and dent which may cause loss of the product or the work.

SUMMARY

This invention describes a pre-assembled canvas for painting or printing which allows flat storage and transportation, easy assembly to make supports for different thicknesses, as it is based on providing a template structure, with predefined dimensions, pieces, cuts for folding and fastening means aimed to make assembly easier.

It is a foldable supporting structure made up of several flat panels, fastened on a flexible layered substrate for painting or printing, which allows digital or other printing and it works as a hinge at the splicing areas of the panels. The panels are interlocked and separated by "V" longitudinal grooves with an angle between 90°/100°, which allow perpendicular folding of the panels. This design creates a sort of front wall box for painting, plus side walls which have the same thickness of the canvas. The rear walls are the edge the structure is braced on with snap-on connectors.

This layered substrate for painting is a flexible piece, made up of natural or synthetic fabric. It has a front face for painting or printing the work and a rear face where the foldable supporting structure is fastened permanently. The shape outline of the painting or printing substrate is preferably quadrangular or rectangular with some square cuts in each vertex. The sides of the cut match the thickness of the assembled canvas.

This foldable supporting structure is made up of a square or rectangular central panel which is used as a support for the fabric or substrate the artist paints on or prints the piece. At each of its four edges this central panel has a flat bevel, made by grinding the edge between 45°/50°.

The foldable supporting structure has four side panels, forming a perimeter around the central panel. Each of the panels is interlocked and parallel to each of the four sides of the central panel, preferably rectangular. The length of each side panel matches the length of each side of the central panel. Its four edges are beveled between 45°/50°. When the supporting structure is folded, the width of these side panels becomes the thickness of the canvas which also matches the length of the sides of the square cuts, located at the vertexes of the layered substrate.

Interlocked to its outer edge, each of the four side panels has a rear panel. These four rear panels have beveled edges by grinding between 45°/50°. The smaller sides have a side cut between 45°/50°.

These rear panels have through holes interlocked to each of the smaller sides. When the structure is folded and the rear panels are folded making up the rear edge of the canvas, such through holes are interlocked.

The fastening means of all the structure are made up of a framing triangle-shaped piece and some snap-on connectors. The triangle-shaped pieces are set below each corner of the rear panels when the structure is folded.

These triangle-shaped pieces have two through holes, which match in the same axis with the rear panel's through holes. The pin type snap-on connectors are inserted in the rear panel's through holes and the through holes of the triangle-shaped pieces. In this way the panels and the triangle-shaped piece are interlocked, which in turn, interlocks the rear, in each of the four corners of the structure.

Another fastening means may be by using wooden wedges with screws, glue or staples.

The painting substrate may be made up of synthetic or natural fabric, as a base for the paint which acts as a hinge among the panels. It may also be a cellulose or synthetic based film with a printing. In turn, the various panels of the foldable supporting structure may be made up of a material, such as chipboard, plywood, plastic, cardboard, layered plate of molded expanded polystyrene or similar materials.

DESCRIPTION OF THE FIGURES

A detailed description of the model and the figures shall be made in this presentation.

DETAILED DESCRIPTION

Figure 1:
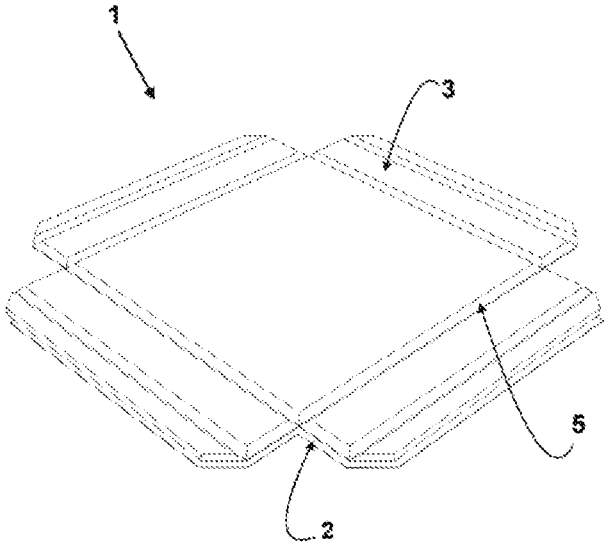
FIG. 1 shows an isometric rear view of the canvas with the painting substrate on the lower side and the upper supporting structure.
Figure 2:
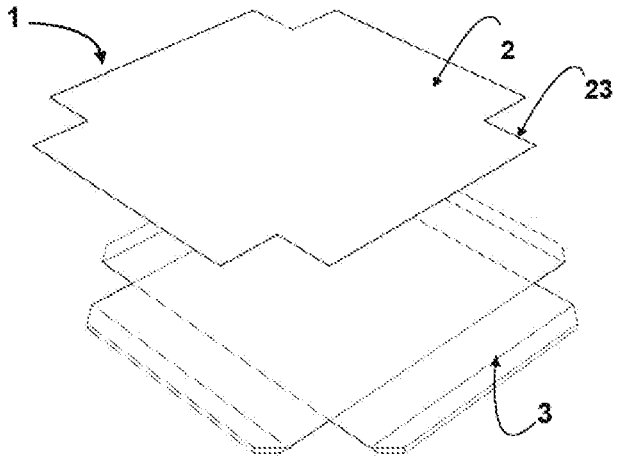
FIG. 2 shows an exploded isometric view of the canvas with the painting substrate on the upper part and the supporting structure below.

The invention includes a pre-assembled canvas for painting, which allows flat storage/transportation. It is easy to assemble to make up supports with assorted thicknesses. FIG. 1 and FIG. 2 show the pre-assembled canvas (1) made up of a foldable supporting structure (3) and a layered substrate for painting or printing (2). The substrate is a flexible flat piece. The supporting structure is made up of various flat/rigid panels, coplanar when deployed. When folded they are perpendicular among each other and interlocked.

The layered substrate (2) has the same width and length of the foldable supporting structure (3). The shape of the layered substrate (2) for painting is square or rectangular with some square cuts (23) in each vertex.

Figure 3:
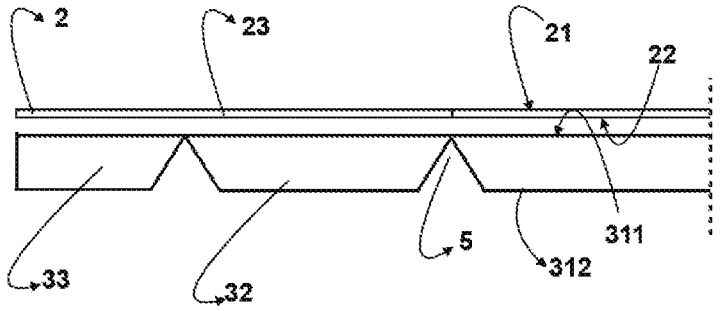
FIG. 3 shows a detailed view of a cut of the canvas where the painting substrate is on the upper part and the supporting structure is below.

FIG. 3 shows the painting substrate (2) has a front face (21) and a rear face (22). The foldable supporting structure (3) is glued onto the rear face (22), made up of several panels separated by "V" longitudinal grooves (5) with a 90° angle. This allows perpendicular folding of each of the panels.

Figure 4:
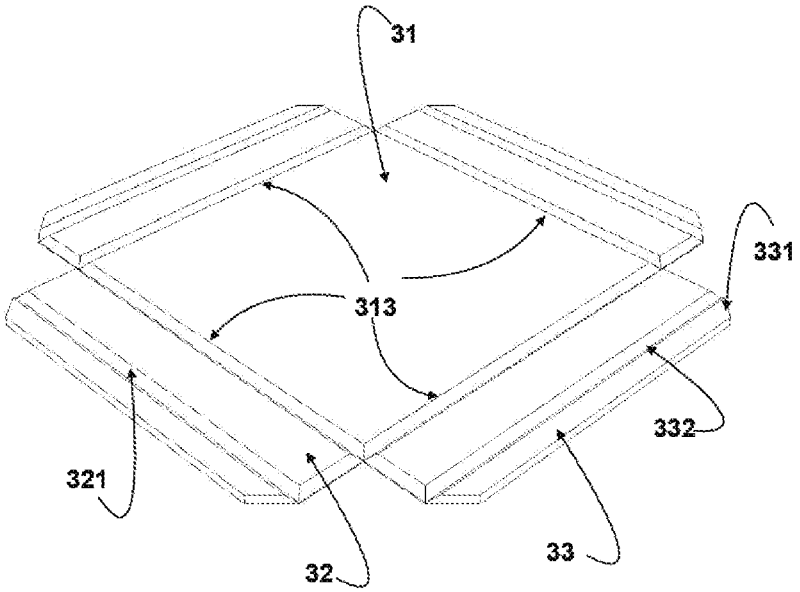
FIG. 4 shows the supporting structure deployed.

FIG. 4 shows this foldable supporting structure (3) made up of a central panel (31), four side panels (32) forming a perimeter around the central panel and four rear panels (33) interlocked to each of those side panels (32).

The central panel (31) of the supporting structure is quadrangular. It has a front face (311), a rear face (312), (FIG. 3). Its four edges have a bevel (313) between 45°/50°. This central panel is the rear support of the layered substrate (2) for painting.

The side panels (32) are interlocked to each of the four edges of the central panel (31). They are rectangular and make up the thickness of the frame. Each of its four edges has a bevel (321) between 45°/50°.

The rectangular rear panels (33) have smaller sides (331) and are cut on a side with an angle between 45°/50°. The edges have a bevel (332) between 45°/50°. These panels made up the rear edge of the supporting structure (3).

FIG. 3 shows the sides of the square cut (23) on the layered substrate (2) matching the width of the side panels (32) plus the width of the rear panels (33).

Figure 5:
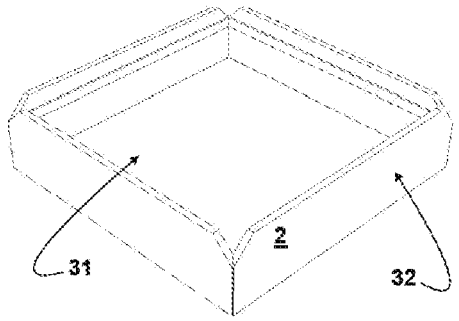
FIG. 5 shows the supporting structure attached to the painting substrate which is on its outer face, half assembled, with the side walls folded.
Figure 6:
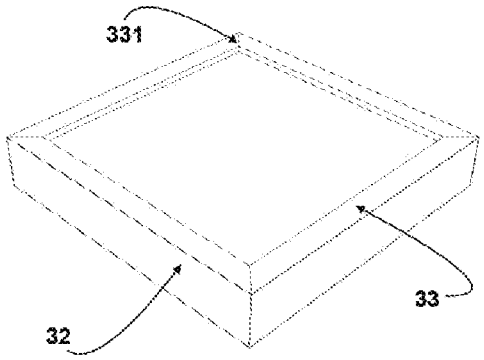
FIG. 6 shows a rear isometric view of the canvas for painting, fully assembled with all walls folded.
Figure 7:
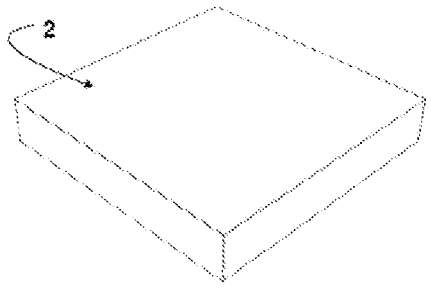
FIG. 7 shows an isometric front view of the canvas for painting, fully assembled with all walls folded.

FIGS. 5, 6 and 7 show side panels (32) are folded perpendicularly to the central panel (31). The painting substrate (2) lies on the outer face. The remaining rear panels (33) are folded perpendicularly to the side panels (32) and parallel to the central panel (31). The ends (331) of the rear panels (33) are cut in an angle of 45° make up a continuous rear edge of the canvas.

Figure 8:
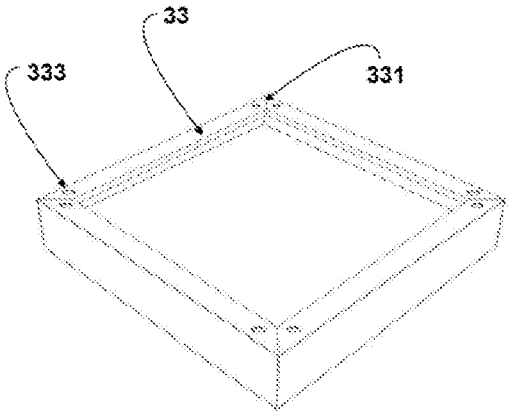
FIG. 8 shows a rear isometric view of the canvas for painting, fully assembled with all walls folded and the through holes are on the rear walls.
Figure 9:
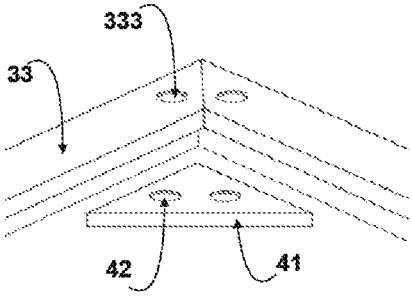
FIG. 9 shows an isometric view of a detail at the rear corner of the canvas, fully assembled, with the triangle-shaped piece which is a part of the fastening means.
Figure 10:
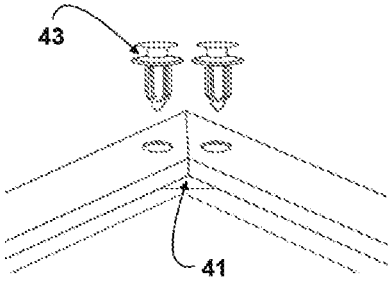
FIG. 10 shows an isometric view of a detail at the rear corner of the canvas, fully assembled, with the triangle-shaped piece as part of the fastening means already set under the rear walls and the snap-on connectors showing the direction of insertion, in order to fix the pieces.

FIG. 8 shows the rear panels (33) with through holes (333) and interlocked to each of the smaller sides (331). FIGS. 9 and 10 show the fastening means are made up of a square-shaped piece (41) lying under each corner of the rear panels (33) when the structure is folded. It has through holes (42) and snap-on connectors (43).

Figure 11:
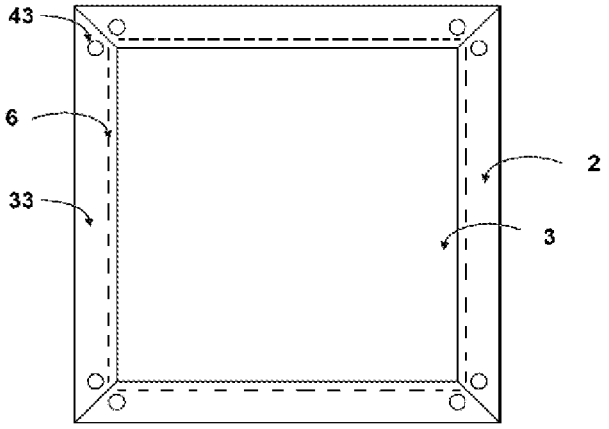
FIG. 11 shows the painting substrate fixed on the supporting structure by perimeter staples on the rear panels.

FIG. 11 shows the second option to attach the painting substrate (2) to the foldable support (3) on the supporting structure (3) by using staples (6) forming a perimeter on the rear panels (33) once the painting substrate has been assembled (6).

What is claimed is:

1. A pre-assembled canvas for painting or printing which allows flat storage and transportation, it is easy to assemble and has supports with different thicknesses, comprising:

a foldable supporting structure comprising a central panel having a quadrangular shape; four side panels forming a perimeter around the central panel; and four rear panels interlocked to each of the side panels, said rear panels are rectangular with smaller sides having through holes adjacent to each of said smaller sides, said panels are separated by "V" longitudinal grooves with angle between 900 and 1000 which allows perpendicular folding of each of the panels to form a frame having a thickness;

a flexible layered painting or printing substrate comprising a front face and a rear face having a quadrangular shape with square cuts at each vertex, the sides of the square cuts matching the width of the side panels plus the width of the rear panels, wherein the substrate is attached to the foldable supporting structure by using staples on the rear panels, so that a perimeter is formed on said rear panels once the foldable supporting structure is folded;

the canvas having fastening means attached to the rear panels, said fastening means corresponding to triangle-shaped pieces located under each corner on the rear panels when the foldable supporting structure is folded, said triangle-shaped pieces having two through holes having axes that match axes of the through holes of the rear panels in each corner formed when the foldable supporting structure is folded;

and the triangle-shaped pieces are fixed to the rear panels by snap-on connectors that are inserted in the through holes of the rear panels and the through holes of the triangle-shaped pieces forming a splicing among the rear panels.

2. The pre-assembled canvas for painting or printing according to claim 1, wherein the central panel of the folding supporting structure has a front face, a rear face, and four edges with a bevel between 45° and 50°, where the central panel is a rear support of the painting or printing layered substrate for.

3. The pre-assembled canvas for painting or printing according to claim 1, wherein the central panel of the folding supporting structure has a front face, a rear face, and four edges; wherein the side panels are interlocked to each of the four edges of the central panel, are rectangular and make up the thickness of the frame, where each of the four edges has a bevel between 45° and 50°.

4. The pre-assembled canvas for painting or printing according to claim 1, wherein said smaller sides of said rear panels are cut at an angle between 45° and 50° and wherein edges of the rear panels have a bevel between 45° and 50°, wherein the said rear panels form a rear edge of the foldable supporting structure.

5. The pre-assembled canvas for painting or printing according to claim 1, wherein the snap-on connectors are pins.

6. The pre-assembled canvas for painting or printing according to claim 1, wherein said substrate is synthetic or natural fabric used as a base for painting or digital printing.

7. The pre-assembled canvas for painting or printing according to claim 1, wherein said substrate is cellulose or synthetic based film with a printing.

8. The pre-assembled canvas for painting or printing according to claim 1, wherein the central panel, the side panels, and the rear panels of the foldable supporting structure are made of a material selected from the group consisting of chipboard, plywood, plastic, cardboard, and a layered plate of molded expanded polystyrene.

9. The pre-assembled canvas for painting or printing according to claim 1, wherein the substrate has the same width and length of the foldable supporting structure.

* * * * *